United States Patent [19]

Rousselie et al.

[11] 4,024,955

[45] May 24, 1977

[54] AUTOMATIC SORTER FOR FRUITS AND THE LIKE

[76] Inventors: Claude Joseph Rousselie, Les Livonnieres, 49480 St Sylvain D'Anjou; Pierre Lacharlotte, 15, rue Saint Evroult, Angers, both of France

[22] Filed: Sept. 29, 1975

[21] Appl. No.: 617,845

[30] Foreign Application Priority Data

June 24, 1975 France ..... 75.19680

[52] U.S. Cl. ..... 209/121

[51] Int. Cl.[2] ..... B07C 5/16

[58] Field of Search ..... 209/121; 177/236, 251

[56] References Cited

UNITED STATES PATENTS

| | | | |
|---|---|---|---|
| 2,003,561 | 6/1935 | Studley et al. | 209/121 |
| 2,261,303 | 11/1941 | Smith | 209/121 |

*Primary Examiner*—Allen N. Knowles

*Attorney, Agent, or Firm*—Karl F. Ross; Herbert Dubno

[57] ABSTRACT

Objects such as apples are sorted by weight in an apparatus having a train of like sorting cars each pivotal about an axis perpendicular to the transport direction of the cars along a path above a plurality of sorting stations. Each car has a counterweight to one side of its pivot axis with the center of gravity above the pivot axis and is provided with a receptacle adapted to support an object to be sorted above and to the other side of the pivot axis. As the train of cars is moved downstream the counterweight sides are cammed upwardly by an upwardly inclined rail that shortens the moment arm of the counterweight side of the car and increases the moment arm of the object side until the car overbalances and dumps the object out at a sorting station. The camming rail may be constituted by a plurality of short rail sections hinged at points above the sorting stations and vertically adjustable at these points.

8 Claims, 9 Drawing Figures

LOADER
33
25
3'
7'
27
26
20
21
6'

28
29

AUTOMATIC SORTER FOR FRUITS AND THE LIKE

FIELD OF THE INVENTION

The present invention relates to a method of and an apparatus for sorting objects by weight. More particularly this invention concerns a sorting system usable with fruits, vegetables, and the like.

BACKGROUND OF THE INVENTION

In order to sort an object such as an apple it is necessary to use the weight of the object rather than its dimension, as apples, unlike eggs, oranges, or the like are often irregularly shaped. Thus devices are known wherein the incoming objects pass down a trough or the like provided with the plurality of spring-type balances which shunt off to side chutes objects greater or less than a predetermined weight, with the weight cut-off point increasing or decreasing in the direction of travel.

Such devices are usually extremely complicated and, hence, often out of order. Various scale mechanisms must constantly be adjusted for proper operation. Furthermore it is necessary to take the device out of operation for a couple of days at a time frequently in order to give its complicated mechanism a thorough cleaning, as the nature of the sorting operation is inherently dirty and the mechanism of the device is so complicated that its cleaning is a substantial chore.

OBJECTS OF THE INVENTION

It is therefore an object of the present invention to provide an improved apparatus for sorting objects by weight.

Another object is the provision of a sorting system which is extremely simple and does not go out of adjustment.

A further object is to provide a sorting system which can readily be cleaned and which is inexpensive to set up and operate.

SUMMARY OF THE INVENTION

These objects are attained according to the present invention in a method of sorting objects by weight comprising the steps of supporting each of a train of cars for pivoting about a respective horizontal axis, carrying on each car to one side of the axis thereof a respective one of the objects, and disposing to the other side of the axis of each car a counterweight sufficiently heavy to prevent the car when in a median position from tipping downwardly on the side of the carried object. This train of cars is displaced downstream past a succession of sorting stations and each car is tipped at each station from the median position about its axis in an angular sense shortening the horizontal distance between the center of gravity of the counterweight and the car axis relative to the horizontal distance between the center of gravity of the object and the axis. The extent of tip or angular displacement is increased in a downstream direction. Thus a point is reached at which each car will overbalance and dump the object carried by it, this point being determined purely by the weight of the object on the car. As the car is tipped from the median position the fulcrum or balance point between the center of gravity of the counterweight and the center of gravity of the object on the opposite side of the car is shifted toward the counterweight until a metastable position is reached after which further pivoting causes the car to overbalance and dump out its object.

The sorting apparatus according to the present invention therefore has an elongated drive element defining a transport path provided with a succession of pivots each defining one of the car axes and all extending parallel to each other transverse to the path. This elongated drive element may be a bicycle-type chain and the means for tipping the cars about the axes may be cams provided at each of the sorting stations and each slightly higher than the preceeding cam and engageable with a follower on the counterweight side of each car. In such an arrangement the center of gravity of the counterweight and of the object are above the pivot axis for the respective car. Thus lifting of the counterweight side of the car will shorten the horizontal distance between the center of gravity of this side and the pivot axis while lengthening the horizontal distance between the center of gravity of the other side of the car and the pivot axis. This action decreases the moment arm of the counterweight and increases that of the object.

According to this invention the sorting stations are spaced apart along the transport path of the apparatus and the cars thereof are prevented from overbalancing when they are between these stations. Rails may be provided above the lifting rail or cam between the stations in order to prevent this tipping-over of the cars. The sorting stations in accordance with this invention are each provided with means for carrying the objects off in a direction transverse to the path. Such means may be constituted by a conveyor belt or a water-filled trough in which the water continuously moves in the carrying-off direction.

According to yet another feature of this invention the ramp or rail that serves to cam up the counterweight side of the cars is constituted by a plurality of sections each corresponding to a respective sorting station and each vertically displaceable to determine the weight of object to be dumped from the cars at that station.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
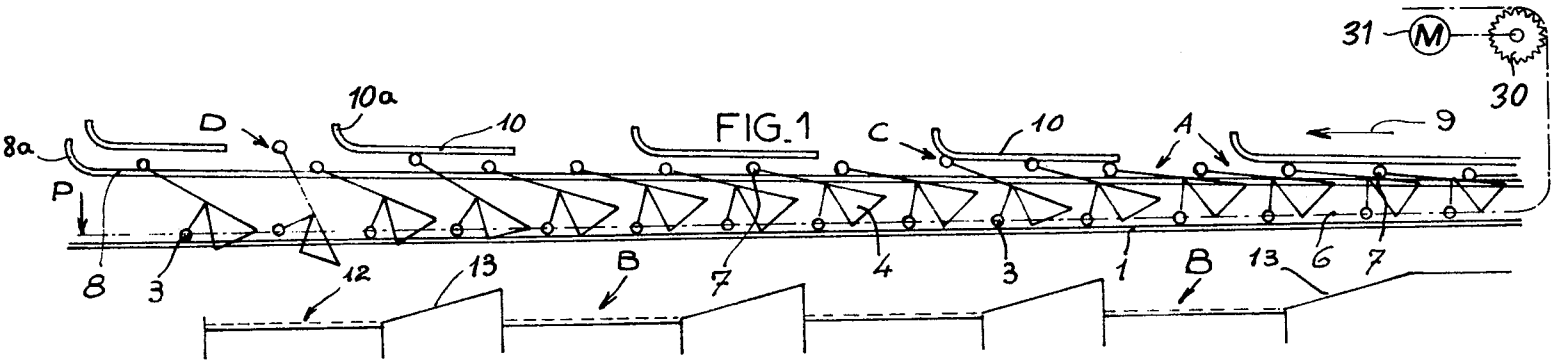
FIG. 1 is a side view of the system for carrying out the method of the present invention.
Figure 3:
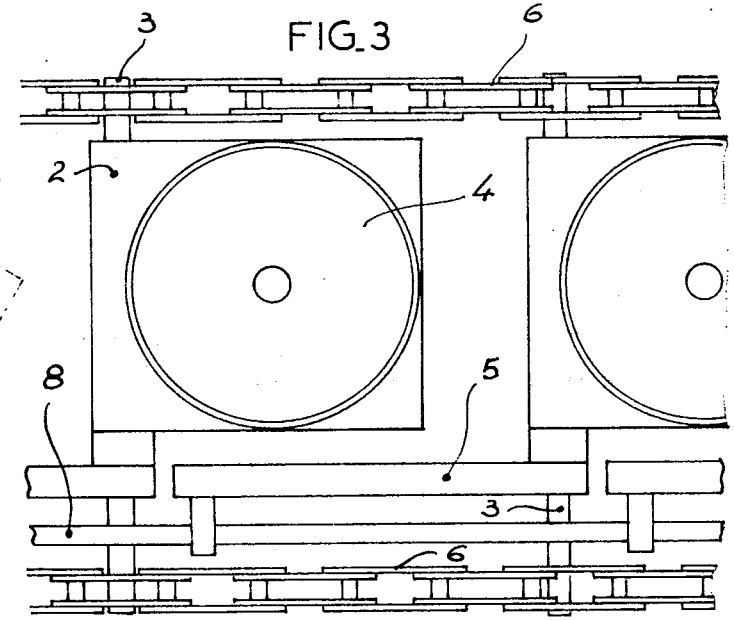
FIGS. 2 and 3 are sectional side and top views, respectively, of one of the cars of the system according to the present invention.
Figure 2:
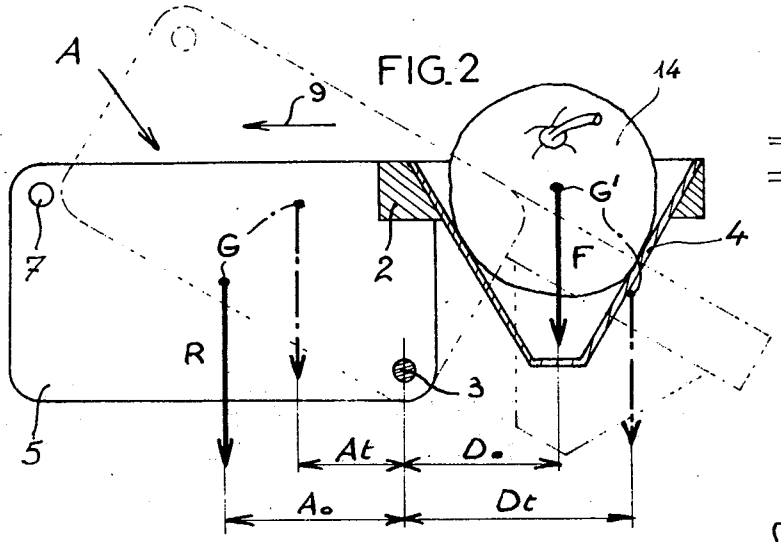

The apparatus shown in FIGS. 1 – 3 has a plurality of sorters A displaceable horizontally above a plurality of sorting stations B. Each sorter A is constituted by a car having a frame 2 pivotal about an axis 3 and carrying to one side of the axis a frustoconical receptacle 4 and to the other side a counterweightplate 5.

Each pivot axis 3 is mounted in a pair of like endless chains 6 at least one of which passes over a sprocket 30 driven by a motor 31 to advance the cars 2 in a direction indicated by arrow 9 with the pivot axes 3 perpendicular to this direction 9 and lying in a common horizontal plane P above the sorting stations B.

Each of the counterweights is provided at its front end with a laterally extending pin follower 7 that rides on top of a common straight rail 8 inclined gently upwardly in the transport direction 9 and formed at its extreme downstream end with an upturned portion 9*a*. Provided above this rail 9 and between the stations B are a plurality of short rails 10 parallel to the rail 8 and themselves formed with upturned downstream ends 10*a*.

Although FIG. 3 only shows one row of such cars 2 between the two chains 6, it is within the scope of the present invention to provide a plurality of such rows each having a respective tipping rail 8.

Each sorting station B comprises an endless transport belt 12 displaceable to move the objects, for example applies 14, away in a direction transverse to the direction 9 and parallel to the plane P. In addition immediately upstream of each belt 12 there is provided a deflection surface 13 extending from the downstream edge of the belt 12 immediately upstream and inclined downwardly in the transport direction 9 to the upstream edge of its respective belt 12.

The device functions as follows:

The counterweight 5 as shown in FIG. 2 has a center of gravity G from which it exerts a downward force indicated by the vector arrow R. Similarly the object 14 in receptacle 4 exerts a downward force F from its center of gravity G'. Originally the car 2 lies in the median position shown in solid lines in FIG. 2 so that the moment arm for the force R is equal to Ao and the moment arm of the object 14 and the receptacle side 4 is equal to Do. The force R is sufficient so that in this median solid-line position the counterweight 5 outweights to object 14 and maintains the object in the position 14 with the follower 7 resting on the rail 8. As the train of cars 2 is displaced in the direction 9 the pins 7 of the cars 2 are cammed upwardly by the rail 8. The horizontal distance and therefore the moment arm of the counterweight 5 decreases to At and the moment arm of object 14 correspondingly increases to Dt.

Depending on the weight of the apple 14, the respective car will have a metastable point beyond which upward displacement of the counterweight 5 will overbalance the car 2. So long as the respective pin 7 is beneath an inhibiting rail 10 all that will happen will be that the car will tip slightly back and the pin 7 will ride along the underside of the respective rail 10 as shown at C in FIG. 1. When, however, the pin 7 comes out beyond the downstream end of the rail 10 the car 2 will be able to tip over as shown at D in FIG. 1 and the apple 14 will be dumped from the receptacle 4 onto the inclined surface 13 and will thence roll onto the respective conveyor belt 12 and be carried away laterally.

The device according to the present invention is extremely simple, the only servicing it needs is greasing of the chains 6 and pivots 3. Since the counterweights 5 extend to the side they may lie next to the preceeding receptacles 4 so that a very compact installation may be provided.

In the arrangement of FIGS. 4 – 9 the reference numerals of FIGS. 1 – 3 are employed with primes to indicate structurally similar elements.

Figures 4, 5, 6, 7:
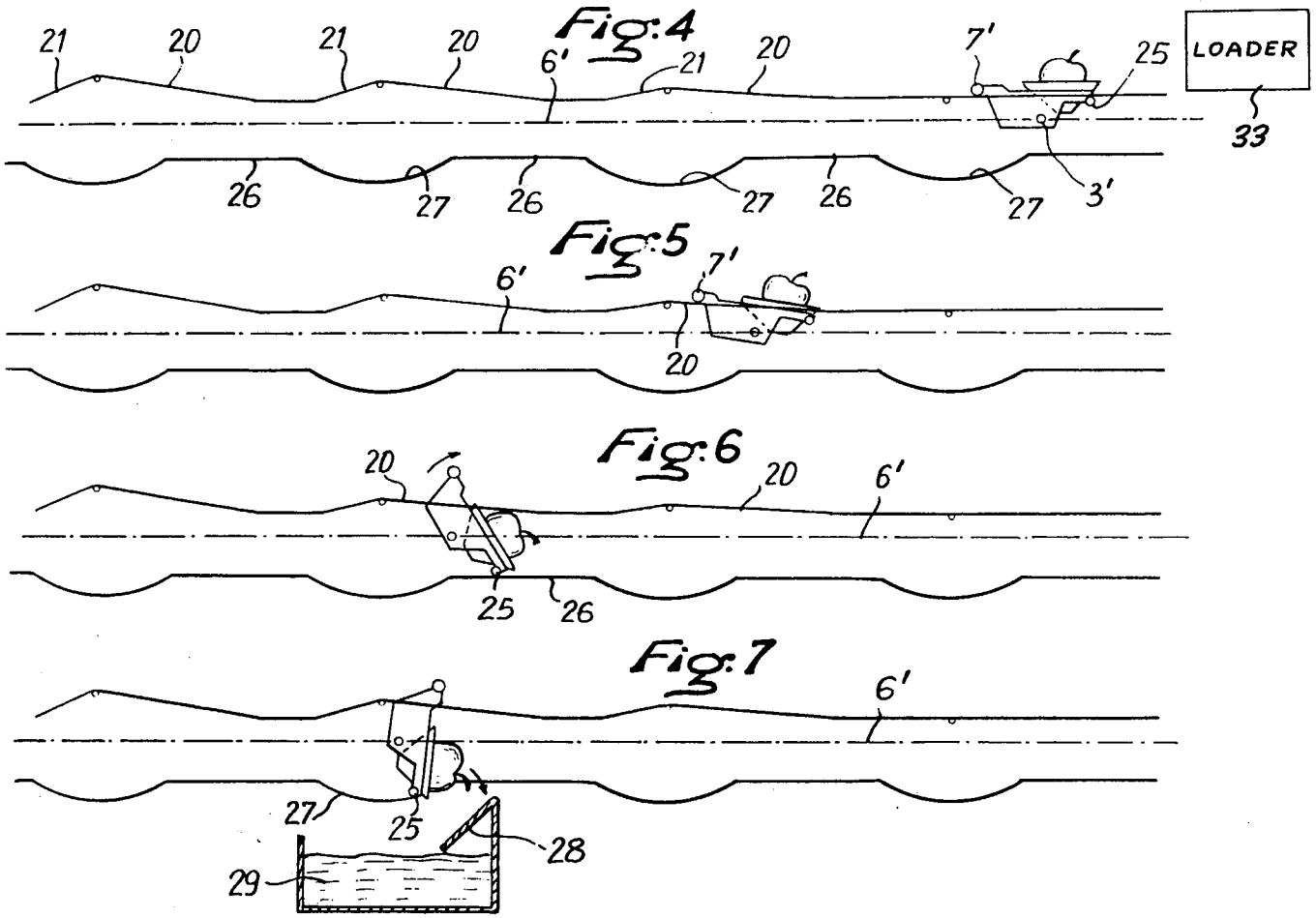
FIGS. 4 – 7 are side schematic views illustrating operation of another system in accordance with this invention.
Figure 8:
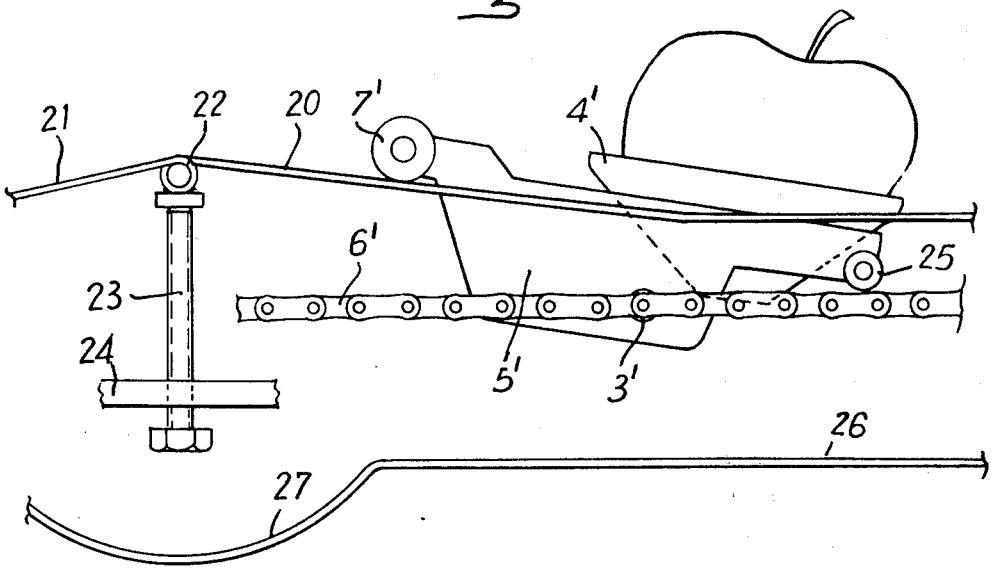
FIGS. 8 and 9 are side and top views, respectively, of the details of the system of FIGS. 4 – 7.
Figure 9:
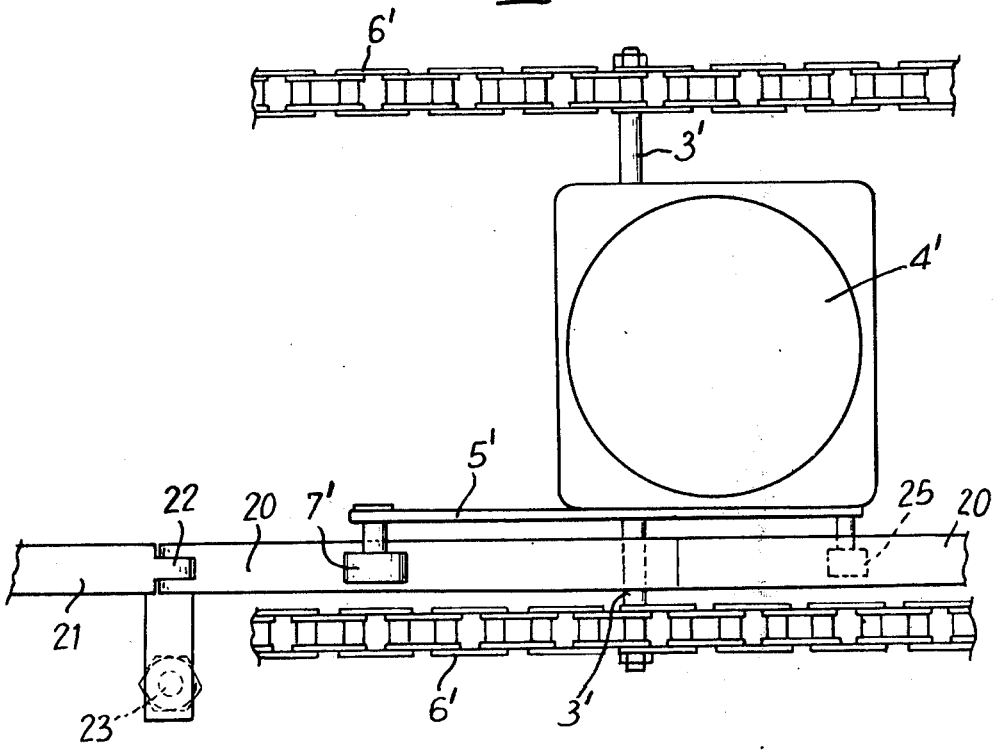

In this arrangement the follower pins 7' ride on a track constituted by a plurality of upwardly inclined sections 20 and downwardly inclined sections 21 hinged together at joints 22 (FIG. 8) which are vertically displaceable relative to the frame 24 of the apparatus by means of adjustment bolts 23. Each of these hinges 22 is provided over a respective sorting station so that each station can be individually adjusted for the apple weight that is to fall off at it. FIG. 4 shows how the extreme upstream station is arranged such that the sections 20 and 21 are parallel and horizontal to the chain 6', and, therefore, no apples will be sorted out at this station.

In addition under each station there is provided an inhibitor formed by horizontal bars 26 parallel to the chains 6' and upwardly concave new-shaped sections 27 each corresponding to a respective sorting station. In FIGS. 4 – 9 for sake of clarity the sections 26 and 27 are shown spaced below the chains 6' by distance which is substantially greater than that used in reality.

The sorters each have a follower roller 25 which is engageable with the horizontal sections 26 to inhibit tipping over of the respective car.

The sorting stations here each comprise a trouth 29 in which water flows in a direction perpendicular to the transport direction of the sorters. An inclined deflector plate 28 is provided at the upstream side of the trouth 29.

The device functions as follows:

As the sorters are displaced downwardly from the apple loader 33 the pins 7' are cammed upwardly as described below. First of all the sorter passes through the flat station at the upstream end of the device as shown at FIG. 4 and thereafter the follower 7' is cammed up as indicated in FIG. 5.

When as shown in FIG. 6 the overbalance point has been reached the roller 25 inhibits the tipping-over of the sorter until the upwardly concave section 27 is reached at which time the object may be dumped out.

Adjustment of the screws 23 allows the sorter to be adjusted and set up to sort the apples into as many groups as there are sorting stations or any smaller number. The higher the hinge 22, the less the objects need weight in order to overbalance the car.

We claim:

1. An apparatus for sorting objects by weight, said apparatus comprising:

an elongated drive element defining a transport path and provided with a succession of pivots defining a succession generally parallel axes transverse to said path, a car rockable on each of said pivots and having a counterweight to one side of the respective pivot and a receptacle adapted to hold a respective one of said objects to the other side of the respective pivot, each counterweight lying alongside and directly flanking the receptacle of an adjacent car, a plurality of sorting stations below and spaced along said path, means connected to said drive element for displacing the succession of said cars along said path past said stations in a transport direction, means at the furthest upstream station for tipping each car from a median position about its axis as it passes said furthese upstream station through a predetermined angular distance in a sense shortening the horizontal distance between the center of gravity of the counterweight and the axis relative to the horizontal distance between the center of gravity of the object and the axis, and means at each of the other stations for tipping each car as it passes each other station in said sense through respective angular distances each greater than the angular distance through which the car was tipped in the station immediately upstream.

2. The apparatus defined in claim 1 wherein in said median position the centers of gravity of the object and the counterweight of each car lie to either side and above the axis of the respective car.

3. The apparatus defined in claim 2 wherein each car has a plate extending in the transport direction and lying next to the receptacle of the adjacent car, each plate constituting one of the counterweights.

4. The apparatus defined in claim 2 wherein said element is a chain.

5. The apparatus defined in claim 2, further comprising means between said stations for inhibiting tipping of said cars in said sense between said stations to the extent to which the tipping could dump out an object carried in the respective receptacle.

6. The apparatus defined in claim 1 wherein each car is provided with a laterally extending follower, said means at said stations for tipping said cars including a rail engageable with said followers and extending along said path, said rail being inclined to said path.

7. The apparatus defined in claim 6 wherein said rail is formed of a succession of rail sections and hinges between said sections at said stations, said apparatus further comprising screw means at each of said stations for adjustably raising and lowering the respective hinge.

8. An apparatus for sorting objects by weight, comprising:

an elongated drive element defining a transport path and provided with a succession of pivots defining a succession of generally parallel axes transverse to said path;

a car rockable on each of said pivots and having a counterweight to one side of the respective pivot and a receptacle adapted to hold a respective one of said objects to the other side of the respective pivot;

a plurality of sorting stations below and spaced along said path;

means connected to said drive element for displacing the succession of said cars along said path past said stations in a transport direction;

means at the furthest upstream station for tipping each car from a median position about its axis as it passes said furthest upstream station through a predetermined angular distance in a sense shortening the horizontal distance between the center of gravity of the counterweight and the axis relative to the horizontal distance between the center of gravity of the object and the axis;

means at each of the other stations for tipping each car as it passes each other station in said sense through respective angular distances each greater than the angular distance through which the car was tipped in the station immediately upstream therefrom; and respective rail means between each pair of successive stations for inhibiting tipping of said cars in said sense between said stations to the extent to which the tipping could dump out an object carried the respective receptacle.

* * * * *